US005682984A

United States Patent [19]

Hoell et al.

[11] Patent Number: 5,682,984

[45] Date of Patent: Nov. 4, 1997

[54] TWO TIER CAN CARTON

[75] Inventors: Norbert Hoell, Southgate, Ky.; Charles A. Miller, Williamsburg, Ohio

[73] Assignee: The C.W. Zumbiel Co., Cincinnati, Ohio

[21] Appl. No.: 375,555

[22] Filed: Jan. 19, 1995

[51] Int. Cl.[6] ..... B65D 71/40

[52] U.S. Cl. ..... 206/161; 53/467; 53/475; 206/193; 206/427

[58] Field of Search ..... 53/443, 445–447, 53/467, 473, 475; 206/139, 140, 193, 427–430, 434, 435, 161

[56] References Cited

U.S. PATENT DOCUMENTS

| | | | |
|---|---|---|---|
| 2,124,808 | 7/1938 | White et al. . | |
| 2,779,499 | 1/1957 | Chidsey, Jr. . | |
| 3,224,630 | 12/1965 | Spery | 206/140 |
| 3,372,800 | 3/1968 | Arneson | 206/193 |
| 3,933,303 | 1/1976 | Kirby, Jr. . | |
| 4,010,593 | 3/1977 | Graham . | |
| 4,482,090 | 11/1984 | Milliens . | |
| 4,712,676 | 12/1987 | Randall . | |
| 4,756,419 | 7/1988 | Le Bras | 206/430 |
| 5,197,656 | 3/1993 | Hoell et al. . | |
| 5,234,102 | 8/1993 | Schuster et al. . | |
| 5,246,113 | 9/1993 | Schuster . | |
| 5,328,081 | 7/1994 | Saulas . | |
| 5,427,242 | 6/1995 | Oliff et al. | 206/430 |
| 5,437,143 | 8/1995 | Culpepper et al. | 53/445 |
| 5,518,111 | 5/1996 | Stout | 206/193 |

FOREIGN PATENT DOCUMENTS

| | | |
|---|---|---|
| 084977 | 3/1983 | European Pat. Off. . |
| 2679529 | 1/1993 | France . |
| 94/08868 | 4/1994 | WIPO . |

*Primary Examiner*—Jimmy G. Foster
*Attorney, Agent, or Firm*—Wood, Herron & Evans, L.L.P.

[57] ABSTRACT

A sleeve style closed end carton for a can matrix. The carton includes a corner flap formed integral with each side wall at each end of each side wall. Those corner flaps are wrapped around the matrix corner cans in the carton relatively tightly so as to draw all cans of the matrix against one another in a plane normal to the can axis in order to aid in minimizing movement of the cans within the can matrix one relative to the other. The carton also includes a primary compound panel foldably connected along one edge to a first top wall section, and foldably connected along an opposite edge to a second top wall section, those top wall sections together forming the carton's top wall. This primary compound panel is sized so that when it is folded between the first and second top wall sections, then the top, bottom and opposed side walls of the carton are all wrapped relatively tightly around the can matrix in a plane parallel to the can axis also in order to aid in minimizing movement of the cans within the can matrix one relative to the other. And this primary compound panel also functions to provide a reinforced handle for the carton when a handle port is created in each of the two top wall sections on opposite sides of the primary compound panel when the can matrix is fully packaged.

30 Claims, 3 Drawing Sheets

TWO TIER CAN CARTON

This invention relates to cartons. More particularly, this invention relates to sleeve style can cartons.

Cartons are widely used in the beverage industry in the marketing of its products, e.g., beer and soft drinks. Such products are commonly marketed in cans enclosed within a carton, the cans being oriented within the carton in a can matrix configuration. One basic type of carton used in canned beverage products is a sleeve style carton. The sleeve style carton is preliminarily configured in the form of a sleeve open at both ends. The can matrix is then inserted into the sleeve like carton from one end or the other. The carton is then sealed at its ends with end flaps which are part of the carton so as to totally enclose the can matrix within the carton.

There is one basic problem associated with this prior art sleeve style carton which applicant's invention is intended to alleviate. Specifically, the cans tend to jostle or move within the package after being placed in the carton, and the carton ends thereafter sealed, in certain types of prior art sleeve style can cartons. This for the reason that sufficient clearance must be provided in the carton relative to the can matrix so that the cans can be easily loaded or inserted in the carton itself by the packaging machinery. And this clearance allows jostling or knocking of the cans against one another within the package as the package is handled through its distribution channels to the retail consumer.

Now a recent advance in the prior art, is illustrated in U.S. Pat. No. 5,197,656 assigned to the assignee of this application. This recent sleeve style carton advance is directed to corner flaps formed integral with each side wall at each end of each side wall of the carton. These corner flaps are wrapped around the corner cans of the can matrix after the can matrix is loaded into the sleeve style carton so as to relatively tightly wrap the can matrix about the can side walls of that can matrix, i.e., wrap the can matrix in a plane normal to the can axis, so that jostling or movement of the cans within the package is minimized as the package is handled throughout the distribution channel chain from the can packager to the retail consumer. This sleeve style carton structure, as illustrated and described in the aforementioned U.S. Pat. No. 5,197,656, has indeed provided an effective advance to carton structures, and indeed has provided an advance in minimizing jostling of cans within the packaged can matrix, in the marketplace. But this prior art wraparound corner flap type of sleeve style carton, as illustrated and described in the aforementioned U.S. Pat. No. 5,197,656, provides no structural reinforcement or wrap which is specifically designed to minimize movement of the cans within the can matrix relative one to the other in a direction parallel to the axis of those cans. In other words, and because the sleeve style carton must be sized in its cross-sectional configuration when it is in its filling or sleeve style configuration so as to receive the can matrix from one end thereof, the tolerances or clearances necessary in order to allow entry of the can matrix from an open end of the sleeve configured carton are such that slight movement is still present in the final can carton package for one can relative to the other in a direction parallel to the can's axis.

Accordingly, it has been the primary objective of this invention to provide an improved sleeve style carton for a can matrix where the can matrix is relatively tightly wrapped in two different planes, the first wrap being in a plane normal to the can axis of the can matrix, and the second wrap being in a plane parallel to the can axis of the can matrix, all in an effort to minimize jostling or movement of the cans within the package as the package is handled throughout the distribution channel from the can packager to the retail consumer.

It has been another objective of this invention to provide an improved sleeve style closed end carton for a can matrix where the carton's top wall is provided with separate first and second top wall sections joined together by a primary compound panel foldably connected to each of those top wall sections so as to allow the top wall, side walls, and bottom wall to be relatively tightly wrapped about the circumference of a can matrix in a plane parallel to the can axis, in combination with top end panels foldably connected at each end of each top wall section, each of those top end panels having a pair of first and second top end panel sections foldably connected by a secondary compound panel so that each pair's first and second top end panel sections are properly oriented relative to a bottom end panel section at each end of the package when the top and bottom end panels of the package are closed and sealed after insertion of the can matrix into the carton.

In accord with these objectives, this invention contemplates a sleeve style closed end carton for a can matrix which includes top, bottom and opposed side walls, those walls all being foldably connected one to the other, with bottom end panels foldably connected to opposed ends of the bottom wall. The top wall is provided with first and second top wall sections. A primary compound panel is foldably connected along one edge to the first top wall section and foldably connected along an opposite edge to the second top wall section, those foldable connections being parallel to the foldable connections of the top wall with its opposed side walls. This primary compound panel allows the top wall to be drawn relatively tight when the primary compound panel is interposed between adjacent edges of the first and second top wall sections so as to wrap the top, side and bottom walls relatively tightly around the can matrix in a plane parallel to the can axis in order to aid in minimizing movement of the cans within the can matrix one relative to the other in a direction parallel to the can axis. In preferred form the sleeve style carton also includes a corner flap formed integral with each side wall at each end of each side wall, that corner flap being wrapped around a matrix corner can relatively tightly so as to draw all cans of the can matrix against one another in a plane normal to the can axis during packaging in order to aid in minimizing movement of the cans within the can matrix relative one to the other in a plane normal to the can axis. Further in preferred form, the carton includes a top end panel at each end of the top wall, each top end panel including a first top end panel section foldably connected to the first top wall section, and a second top end panel section foldably connected to the second top wall section. A secondary compound panel is foldably connected between each pair of first and second top end panel sections, each secondary compound panel being foldably connected along one edge to a first top end panel section and foldably connected along an opposite edge to its associated second top end panel section. The primary and secondary compound panels are oriented so that same are all in line one with the other when the first and second top wall sections, and all first and second top end panel sections, are in the same plane so as to ensure alignment of the top end panels in proper orientation with the top wall and with the bottom end panels when same are glued together during the can packaging press after the can matrix has been inserted into an open end of the sleeve style carton.

Other objectives and advantages of the invention will be more apparent from the following detailed description taken in conjunction with the drawings in which.

Figures 1, 3, 4:
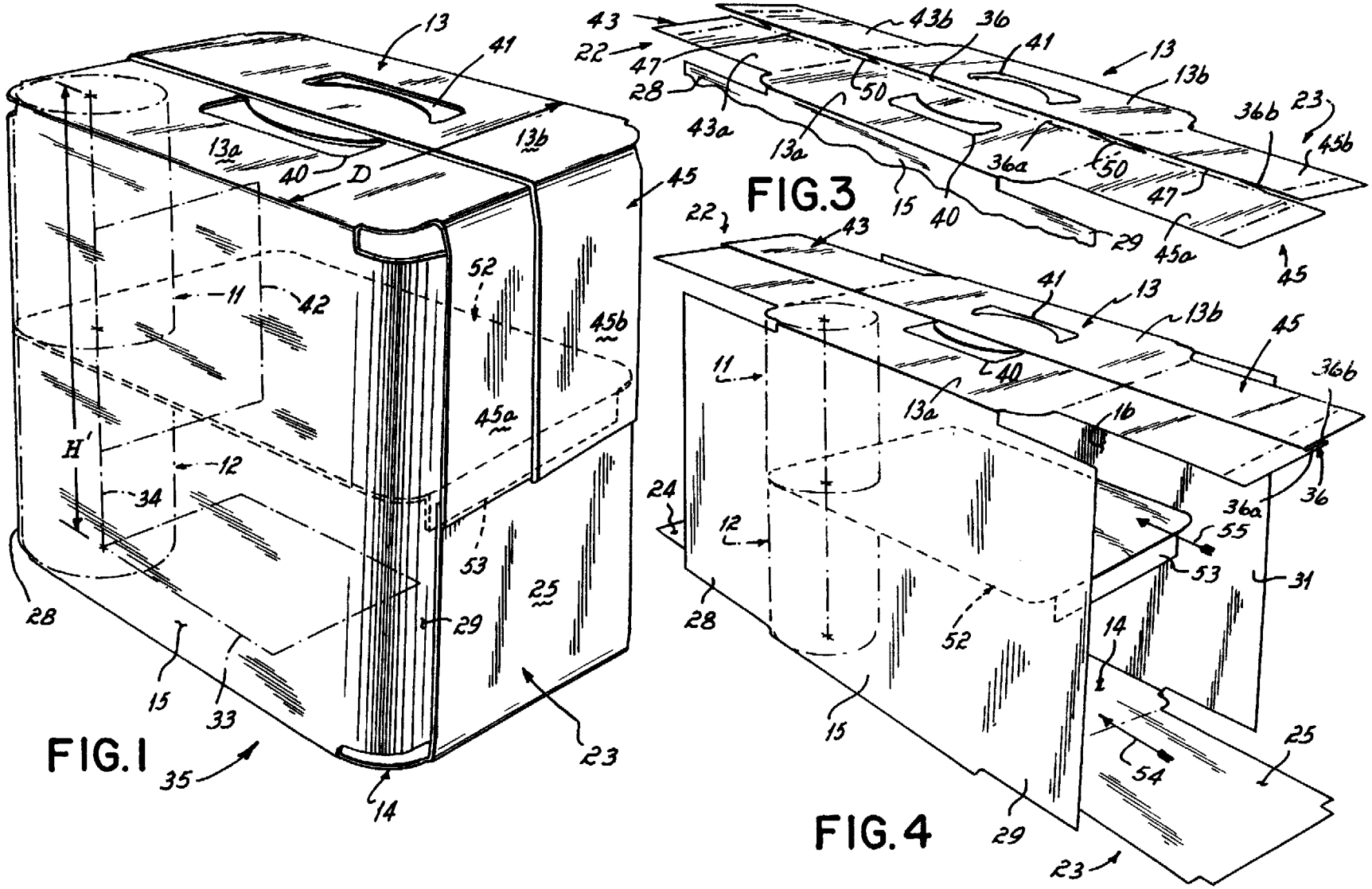
FIG. 1 is a perspective view of a sleeve style two tier closed end carton in accord with the principles of this invention, same being illustrated in final assembled or packaged form with a first can matrix located on a top tier and a second can matrix being located on a lower tier (but with only one can of each of the first and second tiers being illustrated in phantom for purposes of clarity)
FIG. 3 is a partial perspective view of the carton's top wall in a first intermediate assembly stage.
FIG. 4 is a perspective view of the can carton illustrated in FIGS. 1 and 2 in a second intermediate stage, that second intermediate stage being with the first and second can tiers installed but prior to wrapping of the carton's corner flaps and prior to folding of the carton's end panels, only one can of each of the first and second can tiers being illustrated in phantom for purposes of clarity.
Figure 2:
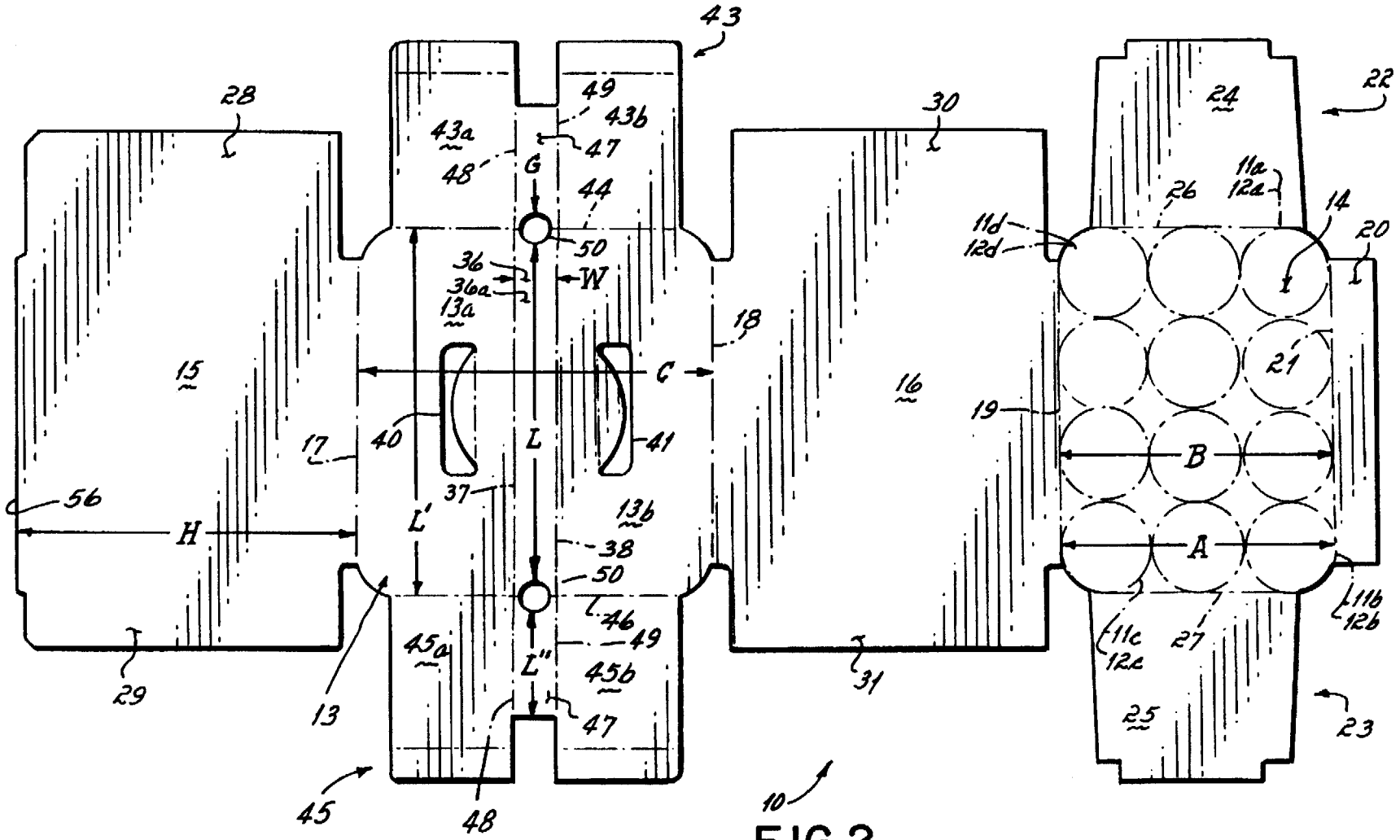
FIG. 2 is a top plan view of a carton blank for the sleeve style two tier closed end can carton illustrated in FIG. 1.

A sleeve style closed end carton blank 10 in accord with the principles of this invention is illustrated in FIG. 2. The carton blank 10, when erected and glued, and with upper 11 and lower 12 can tier matrices enclosed therewith, is as shown in FIG. 1.

The carton blank 10 is comprised of top 13, bottom 14 and opposed side 15, 16 walls. The top wall 13 is foldably connected to first side wall 15 along fold line 17, and is foldably connected to second side wall 16 along fold line 18. The second side wall 16 is foldably connected to the bottom wall 14 along fold fine 19. The other side edge of the bottom wall 14 is provided with a glue flap 20 which is foldably connected along fold line 21 to the bottom wall. Each of the top wall, bottom wall and side walls have opposed ends 22, 23. The opposed ends of the bottom wall 14 are connected to opposed bottom end panels 24, 25 along fold lines 26, 27 respectively. The opposed ends of side wall 15 are provided with corner flaps 28, 29 formed integral with that side wall, and the opposed ends of side wall 16 are provided with corner flaps 30, 31 formed integral with that side wall. Each corner flap 28–31 is wrapped around a pair of matrix corner cans 11*a*, 12*a*; 11*b*, 12*b*; 11*c*, 12*c*; 11*d*, 12*d* relatively tightly so as to draw all cans of each can matrix 11, 12 against one another in a plane 33 normal to can axis 34 in order to aid in minimizing movement of the cans within each can matrix 11, 12 one relative to the other when the carton blank 10 is erected into carton 35 configuration. The corner flaps 28–31 are all connected one with the other, e.g., by lapping and gluing, when so wrapped.

The top wall 13 is comprised of a first top wall section 13*a* and a second top wall section 13*b*. These top wall sections 13*a*, 13*b* are each connected one with another by a primary compound panel 36 foldably connected along one edge on fold line 37 to the first top wall section 13*a* and foldably connected along an opposite edge on fold line 38 to the second top wall section 13*b*. These foldable connections 37, 38 of the primary compound panel 36 with the top wall sections 13*a*, 13*b* are parallel to the foldable connections 17, 18 of the top wall 13 with the opposed side walls 15, 16. This primary compound panel 36 allows the first top wall section 13*a* and the second top wall section 13*b* to overlap one on top the other along the length of the primary compound panel when the carton blank 10 is assembled in the carton 35 configuration as shown in FIGS. 3 and 4. Note particularly the primary compound panel 36 is of the same width W from one end to the other thereof.

The primary compound panel 36 is sized so that when the primary compound panel is folded between the first top wall section 13*a* and the second top wall section 13*b* then the top 13, bottom 14 and opposed 15, 16 side walls are wrapped relatively tightly around the two can matrixes 11, 12 in a plane 42 parallel to the can axis 34 in order to aid in minimizing movement of the cans within each can matrix 11, 12 one relative to the other. In this regard, and when the carton blank 10 is assembled into an erected carton 35 as shown in FIGS. 1 and 4, the primary compound panel 36 is connected, e.g., glued, on its obverse surface 36*a* to an adjacent surface of the first top wall section 13*a* and is also connected, e.g., glued, on its reverse surface 36*b* to an adjacent under or inside surface of the second top wall section 13*b*. Note particularly the height H of each side wall section is substantially equal to but preferably not significantly greater then the height H' of two cans stacked one on top the other (since the carton 35 as illustrated is adapted for use with a two tier can matrix 11, 12). Note also the width A of the bottom wall 14 is substantially equal to but not significantly greater then the width B of each can matrix 11, 12. And note further that the width C of the top wall 13 when in carton blank 10 configuration as shown in FIG. 2, is substantially equal to the width D of the top wall when in erected carton configuration as shown in FIG. 1 plus no more than three times the width W of the primary compound fold panel 36. It is this dimensional relationship of the top wall 13 vis-a-vis the primary compound fold panel 36 which, along with the height H, H' relationship of the side walls 15, 16 and the width A, B relationship of the bottom wall 14 that allows the top 13, bottom 14 and side 15, 16 walls to be wrapped relatively tightly around the two can matrixes 11, 12 in a plane 42 parallel to the can axis 34. In this regard, note the primary compound panel 36 is of a length L less then the length L' of the top wall 13.

Each of the first top wall section 13*a* and the second top wall section 13*b* comprises a hand port 40, 41 located from the primary compound panel 36 a distance at least equal to the width W of that primary compound panel. The hand ports 40, 41 are thereby located on either side of the overlapped area of the primary compound panel 36 when the first top wall section 13*a* is lapped with the second top wall section 13*b* so as to create a triple thickness or reinforced carrying handle for the carton again as illustrated in FIGS. 1 and 4. This reinforced carrying handle is particularly useful with the two tier can carton 35.

The carton blank 10 also includes an end panel 43 foldably connected along fold line 44 to one end of the top wall 13, and an end panel 45 foldably connected along line 46 to the other end of the top wall. Each end panel 43, 45 includes a first top end panel section 43*a*, 45*a* foldably connected to one end of the first top wall section 13*a* at each end of that top wall section, and a second top end panel section 43*b*, 45*b* foldably connected to the second top wall section 13*b* at each end of that top wall section. A secondary compound panel 47 is foldably connected between each pair 43*a*, 43*b*; 45*a*, 45*b* of first and second top end panel sections. Each secondary compound panel 47 is foldably connected along fold line 48 to a first top end panel section 43*a*, 45*a* and foldably connected along fold line 49 to its associated second top end panel section 43*b*, 45*b*. The foldable connection 48 of each of the secondary compound panels 47 with its associated first top end panel section 43*a*, 45*a* is co-linear with that foldable connection 37 of the primary compound panel 36 with the first top wall section 13*a*, and the foldable connection 49 of each of the secondary compound panels 47 with its associated second top end panel section 43*b*, 45*b* is co-linear with that foldable connection 38 of the primary compound panel 36 with the second top wall section 13*b*. In other words, the secondary compound panels 47 are both of the same width W as the primary compound panel 36, and are all located in-line one with the other, when the first top wall section 13*a* and the second top wall section 13*b*, and when all first top end panel sections 43*a*, 45*a* and second top end panel sections 43*b*, 45*b*, are in the same plane, i.e., are in carton blank 10 configuration as illustrated in FIG. 2.

The primary compound panel 36, as earlier mentioned, allows the first top wall section 13*a* and the second top wall section 13*b* to be overlapped one on top the other along the length L of the primary compound panel. And importantly relative to this invention, the secondary compound panels 47 allow the first top end panel section 43*a*, 45*a* and the second top end panel section 43*b*, 45*b* at each end of the carton to be likewise overlapped one on top the other along the length L" of the secondary compound panels to the same extent. This is important during packaging of the two tier can carton 35 because it ensures that the first top end panel section 43*a*, 45*a* and the second end panel section 43*b*, 45*b* of each of the opposed top end panels 43, 45 will be properly and appropriately overlapped relative one to the other, and relative to the top wall 13 itself, when the top end panels 43, 45 are folded from the intermediate carton assembly attitude illustrated in FIG. 4 into the final glued carton 35 configuration illustrated in FIG. 1. Note particularly, as illustrated in FIG. 2, that there is structure 50 partially provided in the top wall 13 and partially provided in each of the top end panels 43, 45, that defines a gap G between the primary compound panel 36 and that secondary compound panel 47 adjacent thereto. This gap G is of a width at least equal to the width W of the primary compound panel 36. Each gap G, as noted, is partially defined by the first top wall section 13*a* and by the second top wall section 13*b*, and also is partially defined by a pair of the first top end panel section 43*a*, 43*b* and the second top end panel section 45*a*, 45*b*. This gap G ensures that the fold line 44, 46 at each end of the top wall 13 will be of only a single paperboard thickness in those non-compound fold areas of the primary compound panel 36 and secondary compound panels 47 so as to enhance folding of the top end panels 43, 45 relative to the rest of the carton during the final end panel 24, 25; 43, 45 gluing step.

An intermediate floor panel 52 is interposed in the two tier can carton 35 of this invention between the upper can matrix 11 and the lower can matrix 12. This intermediate floor 52 is simply in the form of a paperboard sheet having a locator flap 53 at one end thereof. During assembly of the carton blank 10 with the two can matrices 11, 12, the lower can matrix 12 is first inserted in the direction shown by phantom arrow 54 in an open end of the carton, the intermediate floor 52 then installed thereon or having previously been laid thereupon prior to insertion, so that the locator flap 53 is on the trailing end thereof. And then the upper can matrix 11 is installed on the intermediate floor in the direction shown by phantom arrow 55. The locator flap 53, of course, simply prevents the intermediate floor 52 from being removed out of alignment with the lower can matrix 12 as the upper can matrix 11 s being installed in the carton's open end.

The carton's glue flap 20 is connected along fold line 21 to the free side edge of the bottom wall 14, as previously noted. This glue flap 20 is glued along its length to the bottom edge 56 of its associated side wall 15 so as to translate the carton blank 10 from the blank configuration shown in FIG. 2 into the intermediate open end assembly position shown in FIG. 4, i.e., so as to establish the top 13, bottom 14 and opposed 15, 16 side walls in sleeve style configuration.

Figure 5:
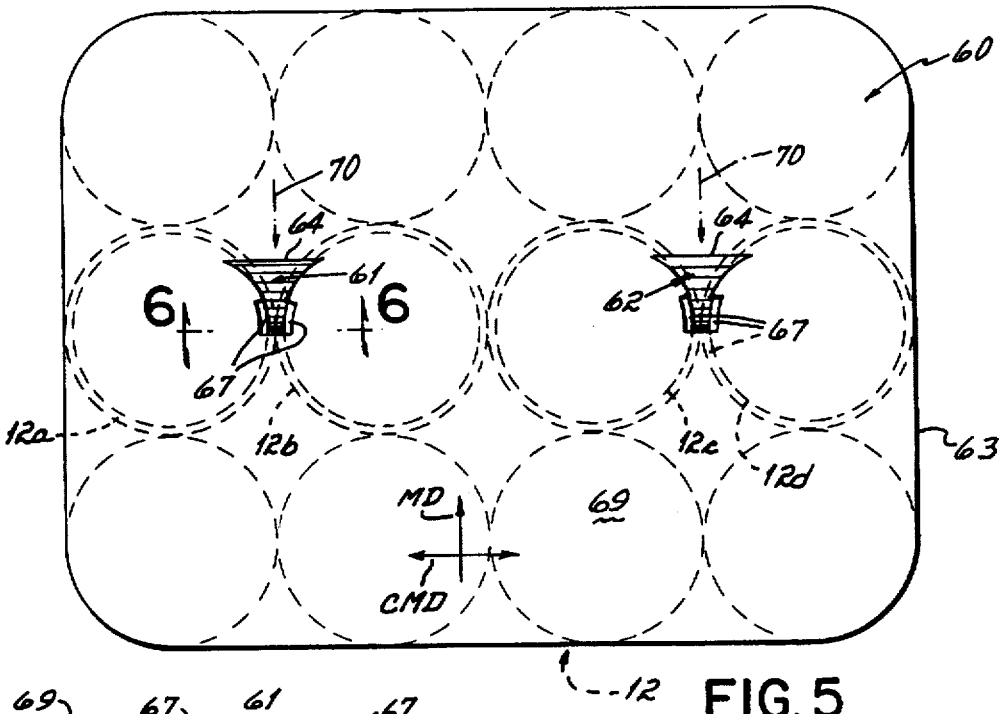
FIG. 5 is a top plan view of an alternative intermediate floor usable in the sleeve style two tier closed end carton illustrated in FIGS. 1–4.
Figure 6:
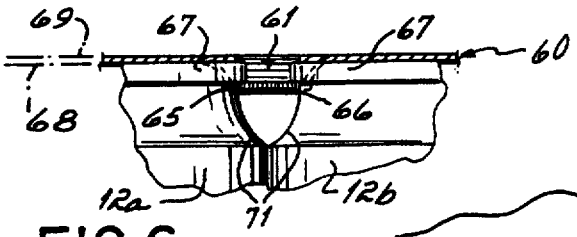
FIG. 6 is a cross-sectional view taken along lines 6—6 of FIG. 5.
Figure 7:
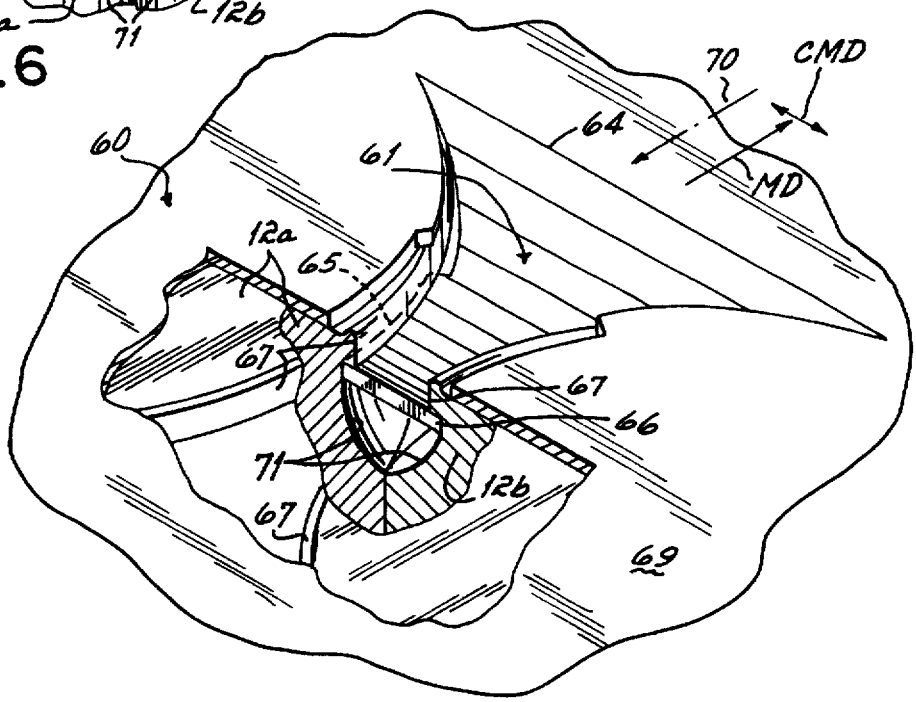
FIG. 7 is a partially broken away and enlarged perspective view of a locator tab which is part of the alternative intermediate floor, and shown in assembly with adjacent cans of a lower can matrix.

An alternative embodiment of an intermediate floor 60 is illustrated in FIGS. 5–7, this alternate also being usable with the two tier sleeve style closed end carton illustrated in FIGS. 1–4. This alternative intermediate floor 60 incorporates depressible locator tabs 61, 62 located within the periphery 63 of that intermediate floor. These depressible locator tabs 61, 62 function to aid location of the intermediate floor 60 in relatively precise peripheral alignment with the carton's lower can matrix 12 so that the floor 60 does not extend beyond the edge of the upper 11 and lower 12 can matrices when same are pushed into the open ended sleeve style carton, as illustrated in FIG. 4, along and in the direction shown by arrows 54 and 55. Note this alternative intermediate floor 60 eliminates the need for locator flap 53 used with intermediate floor 52, as shown in FIG. 4. Indeed, the depressible locator tabs 61, 62 of this alternative intermediate floor 60 embodiment function to locate that floor on the lower can matrix 12 in both a machine direction MD and a cross machine direction CMD whereas the locator flap 53 on the intermediate floor 52 only functions to locate the intermediate floor 52 in the cross machine direction CMD on the lower can matrix. It is important that the intermediate floor 60 be properly located on the lower can matrix 12 before it and that matrix 12 is inserted into the two tier can carton in the direction shown by arrow 54 so that the intermediate floor is not knocked out of alignment during that entry push.

More specifically, the alternative embodiment interior floor 60 includes locator tabs 61, 62 which are depressible downwardly out of the plane of that floor as shown in FIG. 7. The locator tabs 61, 62 are positioned on the intermediate floor 60 so that same are oriented, from a top plan view, basically between two adjacent cans 12*a*, 12*b* and 12*c*, 12*d* of the can matrix 12. Further, the locator tabs 61, 62 are positioned on the intermediate floor 60 so that the hinge line 64 of each is located downstream (relative to the machine direction MD of the carton as it is being loaded) of the tangent contact point 65 of those two cans 12*a*, 12*b* with which it cooperates, and so that the hinge line 64 is oriented normal to the machine direction MD of the lower can matrix 12 and intermediate floor as it is processed through a packaging machine (not shown). In addition, each locator tab 61, 62 includes outwardly flared arrow points 65, 66 adapted to interfit beneath and cooperate with the chimes 67 or top end edges of the cans 12*a*, 12*b* and 12*c*, 12*d* with which each tab 61, 62 cooperates. When the locator tabs 61, 62 are depressed or pivoted on hinge line 64 beneath the top plane 68 of the can matrix 12, and when the arrow points 65, 66 are appropriately and properly engaged beneath and with the chimes 67 of the adjacent cans 12*a*, 12*b*, and 12*c*, 12*d* then the intermediate floor 60 is substantially precisely aligned with the lower can matrix 12 so that the floor's periphery 63 overlies the periphery of the can matrix, i.e., so that the floor is not out of alignment with the lower can matrix when that can matrix and the intermediate floor are inserted into an open sleeve two tier can carton in the direction of arrow 54 as shown in FIG. 4.

In assembly of the alternative embodiment intermediate floor 60 with the lower can matrix 12, same is initially overlaid onto the top plane 68 of the lower matrix cans 12. Deflector fingers (not shown) of packaging machinery (not shown) then deflect or pivot the locator tabs 61, 62 downwardly on hinge lines 64 beneath the intermediate floor's horizontal plane. This orients the arrow points 65, 66 of the deflector tabs beneath the chimes 67 of each pair 12*a*, 12*b* and 12*c*, 12*d* of adjacent cans. Subsequently, the intermediate floor 60 and lower can matrix 12 assembly is passed in the MD beneath a stationary brash (not shown) which brushes against the top surface 69 of the intermediate floor. This imparts a slight rearward force (see phantom arrow 70) onto the intermediate floor 60 relative to the machine direction MD of the packaging machinery (not shown). And this slight rearward force 70 causes the locator tabs' arrow points 65, 66 to become firmly located beneath the can's chimes 67 which they serve, thereby in turn properly locating the intermediate floor 60 on the top surface 68 of the lower can matrix 12. These locator tabs 61, 62 once properly located beneath the cans' chimes 67 which they serve, prevent further rearward movement of the intermediate floor 60 relative to the machine direction MD of the packaging machinery (not shown), and also prevent further cross-machine direction MD movement of the intermediate floor relative to the lower can matrix 12 because same are entrapped in the cavity defined between the cans' shoulders 71 and chimes 67 as particularly shown in FIG. 7.

The relevant disclosure of U.S. Pat. No. 5,197,656, assigned to the assignee of this application, is hereby incorporated by reference.

Having described in detail the preferred embodiment of my invention, what I desire to claim and protect by Letters Patent is:

1. A sleeve style closed end carton for a can matrix, said carton comprising top, bottom and opposed side walls, said walls being foldably connected one to the other, each of said walls having opposed ends, and said top wall having first and second top wall sections, a primary compound panel foldably connected along one edge to said first top wall section and foldably connected along an opposite edge to said second top wall section, said foldable connections of said primary compound panel with said top wall sections being parallel to said foldable connections of said top wall with said opposed side walls, a first top end panel section foldably connected to said first top wall section at each said end of said top wall, and a second top end panel section foldably connected to said second top wall section at each end of said top wall, and a secondary compound panel foldably connected between each pair of first and second top end panel sections, each secondary compound panel being foldably connected along one edge to a first top end panel section and foldably connected along an opposite edge to its associated second top end panel section, said foldable connection of each said secondary compound panel with its associated first top end panel section being co-linear with that foldable connection of said primary compound panel with said first top wall section, and said foldable connection of each said secondary compound panel with its associated second top end panel section being co-linear with that foldable connection of said primary compound panel with said second top wall section, said primary and said secondary compound panels thereby being oriented in-line one with the other when said first and second top wall sections and all said first and second top end panel sections are in the same plane, said primary compound panel allowing said first and second top wall sections to be overlapped one on top the other along the length of said primary compound panel, and said secondary compound panels allowing said first and second top end panel sections at each end of said carton to be likewise overlapped one on top the other along the length of said secondary compound panels to the same extent.

2. A carton as set forth in claim 1, said primary compound panel being of the same width from one end to the other thereof.

3. A carton as set forth in claim 2, each of said secondary compound panels being of the same width from one end to the other thereof, the width of said primary compound panel and the widths of said secondary compound panels being the same.

4. A carton as set forth in claim 1, said carton comprising structure defining a gap between each end of said primary compound panel and that secondary compound panel adjacent thereto, said gap being of a width at least equal to the width of said primary compound panel.

5. A carton as set forth in claim 2, each said gap being partially defined by said first and second top wall sections, and partially defined by a pair of said first and second top end panel sections.

6. A carton as set forth in claim 1, each of said first and second top wall sections comprising a hand port located from said primary compound panel a distance at least equal to the width of said primary compound panel, said hand ports thereby being located on either side of the overlapped area of said primary compound panel and said first and second top wall sections so as to cream a reinforced carrying handle for said carton.

7. A sleeve style carton for a can matrix, said matrix being formed from plural cans where the axis of each can is parallel to the axis of every other can, said carton comprising top, bottom and opposed side walls, said walls being foldably connected one to the other, each of said walls having opposed ends, and said top wall having first and second sections, a corner flap formed integral with each side wall at each end of each side wall, each corner flap being wrapped around a matrix corner can relatively tightly so as to draw all cans of said can matrix together against one another in a plane normal to said can axes, in order to aid in minimizing movement of the cans within said can matrix one relative to the other, said corner flaps being connected one with the other when so wrapped, a primary compound panel foldably connected along one edge to said first top wall section and foldably connected along an opposite edge to said second top wall section, said foldable connections of said primary compound panel with said top wall sections being parallel to said foldable connections of said top wall with said opposed side walls, said primary compound panel being sized so that when said primary compound panel is folded between said first and second top wall sections that said top, bottom and opposed side walls are wrapped relatively tightly around said can matrix in a plane parallel to said can axes also in order to aid in minimizing movement of the cans within said can matrix one relative to the other, said primary compound panel being connected on its obverse surface to an adjacent surface of said first top wall section and on its reverse surface to an adjacent surface of said second top wall section when so wrapped.

8. A carton as set forth in claim 7, each of said first and second top wall sections comprising a hand port located from said primary compound panel a distance at least equal to the width of said primary compound panel, said hand ports thereby being located on either side of the overlapped area of said primary compound panel and said first and second top wall sections so as to create a reinforced carrying handle for said carton.

9. A carton as set forth in claim 7, said primary compound panel being of the same width from one end to the other thereof.

10. A carton as set forth in claim 9, said primary compound panel being of a length less than the length of said top wall.

11. A carton as set forth in claim 7, said carton comprising a first top end panel section foldably connected to said first top wall section at each said end of said top wall, and a second top end panel section foldably connected to said second top wall section at each end of said top wall, and a secondary compound panel foldably connected between each pair of first and second top end panel sections, each secondary compound panel being foldably connected along one edge to a first top end panel section and foldably connected along an opposite edge to its associated second top end panel section, said foldable connection of each said secondary compound panel with its associated first top end panel section being co-linear with that foldable connection of said primary compound panel with said first top wall section, and said foldable connection of each said secondary compound panel with its associated second top end panel section being co-linear with that foldable connection of said primary compound panel with said second top wall section, said primary and said secondary compound panels thereby being oriented in-line one with the other when said first and second top wall sections and all said first and second top end panel sections are in the same plane, said primary compound panel allowing said first and second top wall sections to be overlapped one on top the other along the length of said primary compound panel, and said secondary compound panels allowing said first and second top end panel sections at each end of said carton to be likewise overlapped one on top the other along the length of said secondary compound panels to the same extent.

12. A carton as claimed in claim 11, each of said secondary compound panels being of the same width from one end to the other thereof, the width of said primary compound panel and the widths of said secondary compound panels being the same.

13. A carton as claimed in claim 11, said carton comprising structure defining a gap between each end of said primary compound panel and that secondary compound panel adjacent thereto, said gap being of a width at least equal to the width of said primary compound panel, each said gap being partially defined by said first and second top wall sections and partially defined by a pair of said first and second top wall sections.

14. A sleeve style carton for a can matrix, said matrix being formed from plural cans where the axis of each can is parallel to the axis of every other can, said carton comprising top, bottom and opposed side walls, said walls being foldably connected one to the other, each of said walls having opposed ends, and said top wall having first and second sections, a primary compound panel foldably connected along one edge to said first top wall section and foldably connected along an opposite edge to said second top wall section, said foldable connections of said primary compound panel with said top wall sections being parallel to said foldable connections of said top wall with said opposed side walls, said primary compound panel being sized so that when said primary compound panel is folded between said first and second top wall sections that said top, bottom and opposed side walls are wrapped relatively tightly around said can matrix in a plane parallel to said can axes in order to aid in minimizing movement of the cans within said can matrix one relative to the other, said primary compound panel being connected on its obverse surface to an adjacent surface of said first top wall section and on its reverse surface to an adjacent surface of said second top wall section when so wrapped, and a glue flap foldably connected to one side edge of one of said bottom wall and a side wall, said glue flap being glued along its length to the other of said bottom wall and said side wall, said glue flap by which said stop, bottom and opposed side walls are connected in sleeve style configuration not being directly connected to said top wall.

15. A carton as claimed in claim 14, each of said first and second top wall sections comprising a hand port located from said primary compound panel a distance at least equal to the width of said primary compound panel, said hand ports thereby being located on either side of the overlapped area of said primary compound panel and said first and second top wall sections so as to create a reinforced carrying handle for said carton.

16. A carton as set forth in claim 14, said primary compound panel being of the same width from one end to the other thereof, and said primary compound panel being of a length less than the length of said top wall.

17. A carton as set forth in claim 14, said carton comprising a first top end panel section foldably connected to said first top wall section at each said end of said top wall, and a second top end panel section foldably connected to said second top wall section at each end of said top wall, and a secondary compound panel foldably connected between each pair of said first and second top end panel sections, each secondary compound panel being foldably connected along one edge to a first top end panel section and foldably connected along an opposite edge to its associated second top end panel section, said foldable connection of each said secondary compound panel with its associated first top end panel section being co-linear with that foldable connection of said primary compound panel with said first top wall section, and said foldable connection of each said secondary compound panel with its associated second top end panel section being co-linear with that foldable connection of said primary compound panel with said second top wall section, said primary and said secondary compound panels thereby being oriented in-line one with the other when said first and second top wall sections and all said first and second top end panel sections are in the same plane, said primary compound panel allowing said first and second top wall sections to be overlapped one on top the other along the length of said primary compound panel, and said secondary compound panels allowing said first and second top end panel sections at each end of said carton to be likewise overlapped one on top the other along the length of said secondary compound panels to the same extent.

18. A carton as set forth in claim 17, each of said secondary compound panels being of the same width from one end to the other thereof, the width of said primary compound panel and the widths of said secondary compound panels being the same.

19. A carton as set forth in claim 17, said carton comprising structure defining a gap between each end of said primary compound panel and that secondary compound panel adjacent thereto, said gap being of a width at least equal to the width of said primary compound panel, each said gap being partially defined by said first and second top wall sections and partially defined by a pair of said first and second top end panel sections.

20. An inserted intermediate floor panel in combination with a two tier carton, said carton having an upper package matrix and a lower package matrix therein, said upper matrix being located on top said lower matrix with said floor panel being located therebetween, said intermediate floor panel comprising at least one locator tab defined in said floor panel within the periphery of said floor panel, said tab being deflected out of the plane of said floor panel into engaging relationship with at least one package in said lower matrix, said tab being located between two adjacent packages of said lower matrix, said tab thereby being cooperable with said package to locate said floor panel in a preferred position relative to said lower package matrix.

21. A floor panel combination as claimed in claim 20, said tab cooperating with said package to locate said floor panel in both a machine direction and a cross machine direction relative to said lower package matrix during assembly of said floor panel with said lower package matrix.

22. A floor panel combination as claimed in claim 21, said lower package matrix having plural cans, said tab being engaged with at least one can chime in said lower matrix.

23. A floor panel combination as claimed in claim 22, said tab comprising a head attached to a body, said body being hingedly attached to said floor panel on a tab hinge line.

24. A floor panel combination as claimed in claim 23, said tab being generally located between two adjacent cans of said lower matrix, and said head being of a generally arrow shaped configuration, said arrow shaped head cooperating with both can chimes of adjacent cans in said lower matrix.

25. A floor panel combination as claimed in claim 24, said arrow shaped head being located upstream of said body hinge line relative to the machine direction of said lower matrix during assembly of said floor panel with said lower matrix.

26. A floor panel combination as claimed in claim 25, said arrow shaped head comprising points that interfit beneath the chimes of two adjacent cans in said lower matrix.

27. A method of locating an intermediate floor panel on top a lower package matrix, said method comprising the steps of providing said floor panel with at least one locator tab deflectable out of the plane of said floor panel into engaging relationship with at least one package in said lower matrix, orienting said floor panel on top said lower matrix while moving said lower matrix in a machine direction, deflecting said tab out of the plane of said floor panel toward at least one package of said lower matrix, and exposing said floor panel to a force in a direction different from the machine direction of said floor panel so as to engage said locator tab as desired with said one package in order to locate said floor panel as desired on top said lower matrix.

28. A method as set forth in claim 27, said lower package matrix comprising plural cans, said method comprising the step of engaging said locator tab with the chime of said one can.

29. A method as set forth in claim 28, said method comprising the steps of providing an arrow shaped head on said locator tab, orienting said locator tab between two adjacent cans of said lower matrix, and engaging said arrow shaped head with both chimes of said two adjacent cans.

30. A method as set forth in claim 29, said method comprising the step of exposing said floor panel to a rearward force relative to the machine direction of said floor panel.

* * * * *